US005628299A

United States Patent [19]

Marzonia et al.

[11] Patent Number: 5,628,299

[45] Date of Patent: May 13, 1997

[54] AIR/FUEL CONTROL SYSTEM WITH LOST FUEL COMPENSATION

[75] Inventors: Robert M. Marzonia; Michael J. Cullen, both of Northville, Mich.; Jon Dixon, Great Totham Maldon, England

[73] Assignee: Ford Motor Company, Dearborn, Mich.

[21] Appl. No.: 625,828

[22] Filed: Apr. 1, 1996

[51] Int. Cl.[6] ..... F02D 41/14; F02D 41/04; F02D 17/00

[52] U.S. Cl. ..... 123/672; 123/478; 123/481

[58] Field of Search ..... 123/478, 481, 123/672

[56] References Cited

U.S. PATENT DOCUMENTS 5,483,941 1/1996 Cullen et al. ..... 123/481

*Primary Examiner*—Tony M. Argenbright
*Attorney, Agent, or Firm*—Allan J. Lippa

[57] ABSTRACT

An air/fuel control method for an internal combustion engine. A portion of fuel delivered to the engine which is lost between the piston and engine cylinder walls during predetermined engine operating conditions is calculated. Fuel delivered to the engine is then adjusted for the calculated lost fuel quantity to achieve a desired engine air/fuel ratio.

14 Claims, 5 Drawing Sheets

AIR/FUEL CONTROL SYSTEM WITH LOST FUEL COMPENSATION

BACKGROUND OF THE INVENTION

The field of the invention relates to air/fuel control systems.

It is known to adjust the engine air/fuel ratio during open loop air/fuel control conditions. Under such conditions, fuel is delivered to the engine independently of feedback control. Otherwise, fuel delivered to the engine is adjusted by a feedback variable generated from an exhaust gas oxygen sensor.

It is also known to run the engine lean of stoichiometric combustion under open loop conditions for various reasons. One example is to provide more rapid warm-up of the catalytic converter during cold engine operation by creating excess oxygen in the engine exhaust. Another example of lean operation during engine warm-up is disclosed in U.S. Pat. No. 5,483,941. This particular patent describes cutting off fuel to a preselected number of engine cylinders to reduce engine torque during traction control. During cold engine operation, the air/fuel ratio of the remaining cylinders is run lean of stoichiometry. Otherwise, the oxygen pumped through the deactivated cylinders may mix with unburnt hydrocarbons resulting in an exothermic reaction at the catalytic converter.

The inventors herein have recognized numerous problems with all the approaches described above wherein lean air/fuel operation is attempted under open loop air/fuel conditions. For example, the inventors herein have recognized that the open loop lean air/fuel calculation may be too lean resulting in engine stumbling.

SUMMARY OF THE INVENTION

An object of the invention herein is to provide accurate open loop lean air/fuel control with compensation for fuel lost between the engine piston and cylinder wall during cold engine operation.

The above object is achieved, and problems of prior approaches overcome, by a method for controlling an internal combustion engine having a plurality of combustion chambers coupled to an engine exhaust and thermally communicating with a coolant jacket, each of the combustion chambers including a cylinder having an inner wall with a piston positioned therein. In one particular aspect of the invention, the method comprises the steps of: delivering fuel to the engine; calculating a quantity of the delivered fuel which is lost between the piston and the cylinder inner wall during a predetermined engine operating condition; and adjusting the delivered fuel for the calculated lost quantity to achieve a desired engine air/fuel ratio.

An advantage of the above aspect of the invention, is that accurate engine air/fuel control is achieved by correcting for fuel lost between the cylinder wall and the engine piston.

BRIEF DESCRIPTION OF THE DRAWINGS

The object and advantages of the claimed invention will become more clearly apparent from the following detailed description of an example of operation described with reference to the drawings wherein:

DESCRIPTION OF AN EXAMPLE OF OPERATION

Figure 1:
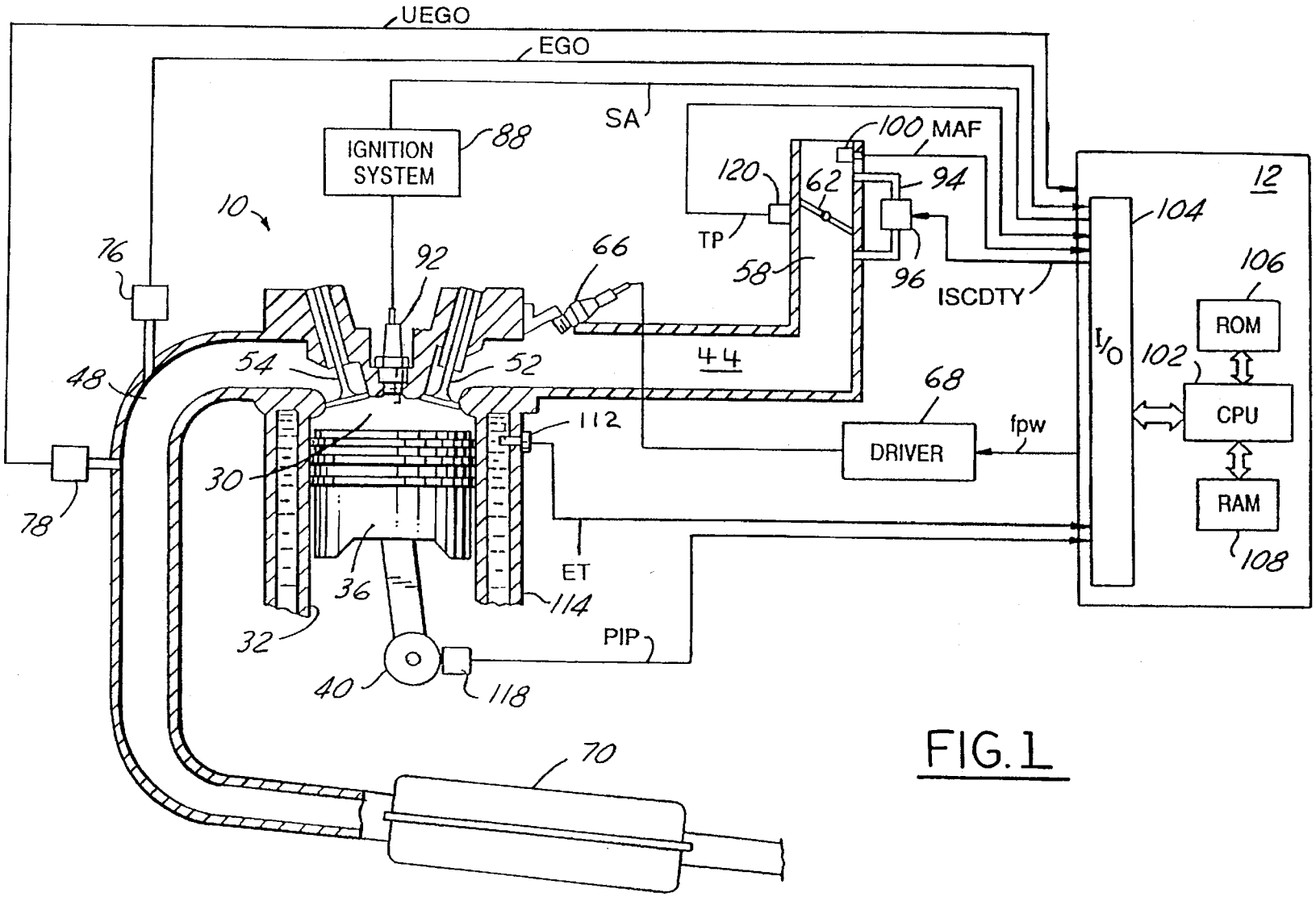
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Engine 10 includes combustion chamber 30 and cylinder walls 32. Piston 36 is positioned within cylinder walls 32 with conventional piston rings and it is connected to crankshaft 40. Combustion chamber 30 is shown communicating with intake manifold 44 and exhaust lo manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal fpw received from controller 12 via conventional electronic driver 68. Fuel is delivered to fuel injector 66 by a conventional fuel system (not shown) including a fuel tank, fuel pump, and fuel rail.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected at stoichiometry which falls within the peak efficiency window of catalytic converter 70.

Proportional air/fuel sensor 78 is also shown coupled to exhaust manifold 48 for providing proportional signal UEGO to controller 12 with an amplitude linearly related to the exhaust air/fuel ratio. As described in greater detail later herein with particular reference to FIG. 6, proportional sensor 78 is used, in this particular example, only during a one time calibration at the factory and may thereafter be removed from engine 10.

Idle bypass passageway 94 is shown coupled to throttle body 58 in parallel with throttle plate 62 to provide air to intake manifold 44 via solenoid valve 96 independently of the position of throttle plate 62. Controller 12 provides pulse width modulated signal ISCDTY to solenoid valve 96 so that airflow is inducted into intake manifold 44 at a rate proportional to the duty cycle of signal ISCDTY for controlling engine idle speed.

Conventional distributorless ignition system 88 provides ignition spark to combustion chamber 30 via spark plug 92 in response to spark advance signal SA from controller 12.

Controller 12 is shown in FIG. 1 as a conventional microcomputer including: microprocessor unit 102, input/output ports 104, an electronic storage medium for storing executable programs and calibration values shown as read only memory chip 106 in this particular example, random access memory 108, and a conventional data bus. Controller 12 is shown receiving various signals from sensors coupled to engine 10, in addition to those signals previously discussed, including: measurement of inducted mass air flow (MAF) from mass air flow sensor 100 which is coupled to throttle body 58 upstream of air bypass passageway 94 to provide a total measurement of airflow inducted into intake manifold 44 via both throttle body 58 and air bypass passageway 94; engine temperature (ET) from temperature sensor 112 which in this particular example is shown coupled to cooling jacket 114 and in other applications may be coupled directly to the engine head; a profile ignition pickup signal (PIP) from Hall effect sensor 118 coupled to crankshaft 40; and throttle position TP from throttle position sensor 120.

Figure 2:
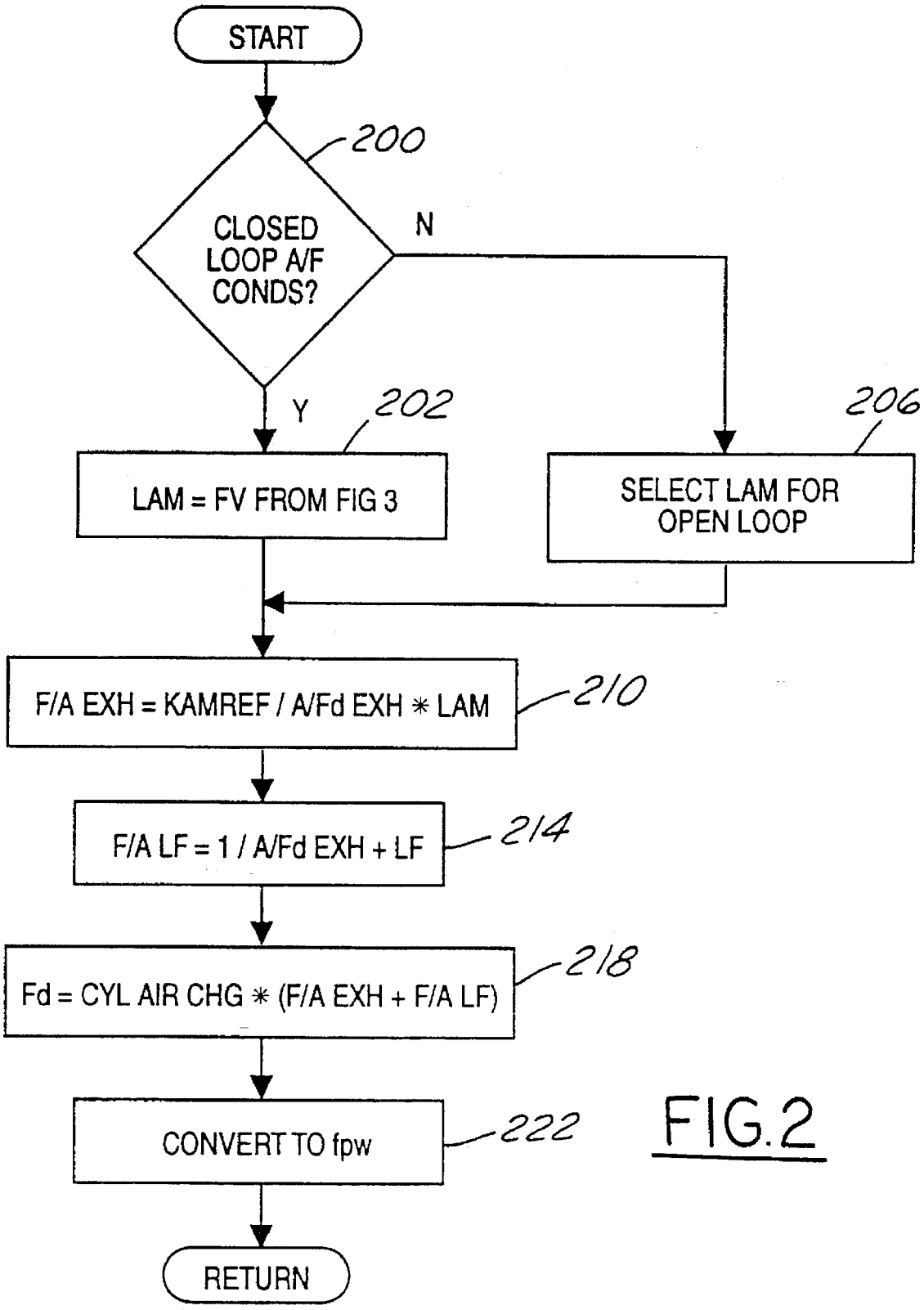
FIGS. 2–4 and 6A–6B are flowcharts describing various operations performed by a portion of the embodiment shown in FIG. 1.

The subroutine for generating fuel pulse width signal fpw by controller 12 to actuate fuel injector 66 is now described with particular reference to FIG. 2. During step 200 a determination is made as to whether controller 12 will operate in closed loop or open loop air/fuel conditions. Under closed loop conditions, fuel delivered to engine 10 is adjusted by feedback variable FV as described in greater detail later herein with particular reference to FIG. 3. As shown in step 202 of FIG. 2, signal LAM, which is an air/fuel equivalence ratio, is set equal to feedback variable FV during step 202.

On the other hand, during open loop conditions, signal LAM is selected for the particular open loop air/fuel operation desired (206). For example, when an air/fuel ratio lean of desired air/fuel ratio A/Fd (typically the stoichiometric air/fuel ratio) is required for engine 10, signal LAM is set to a value greater than unity. And, when an air/fuel ratio richer than desired air/fuel ratio A/Fd, such as when accelerating rapidly, signal LAM is set to a value less than unity.

Exhaust fuel/air ratio F/A EXH is computed by the equation shown in FIG. 210. More specifically, steady-state correction value KAMREF is divided by the product of signal LAM and desired exhaust air/fuel ratio A/Fd EXH. Correction KAMREF is generated in a conventional manner by applying the difference between feedback variable FV and unity to a proportional plus integral (PI) controller.

As described in greater detail later herein with particular reference to FIG. 4, and the alternate embodiment shown in FIG. 5, a calculation of the fuel lost (signal LF) between piston 36 and the inside wall of cylinder 32 is calculated during cold engine operation. Referring to step 214 of FIG. 2, signal LF is multiplied by the reciprocal of desired air/fuel ratio A/Fd EXH to generate the lost fuel fuel/air ratio (F/A LF).

The desired fuel quantity (signal Fd) to be delivered to engine 10 is generated during step 218 as follows. First, the exhaust fuel/air ratio (F/A EXH) is summed with the lost fuel fuel/air ratio (F/A LF). For ease of illustration, a conventional correction for transient fuel is not shown. Transient fuel is the calculation of the difference between the portion of injected fuel which condenses on components of engine 10 and the amount of previously condensed fuel which evaporates. Continuing with step 218, the sum of each fuel/air ratio is multiplied by a calculation of inducted air charge per cylinder (CYLAIRCHG) to generate signal Fd. Signal Fd is then converted to pulse width signal fpw (222) for actuating fuel injector 66 via driver 68 in a conventional manner. Fuel delivered by injector 66 is directly proportional to the width of pulse width signal fpw.

Figure 3:
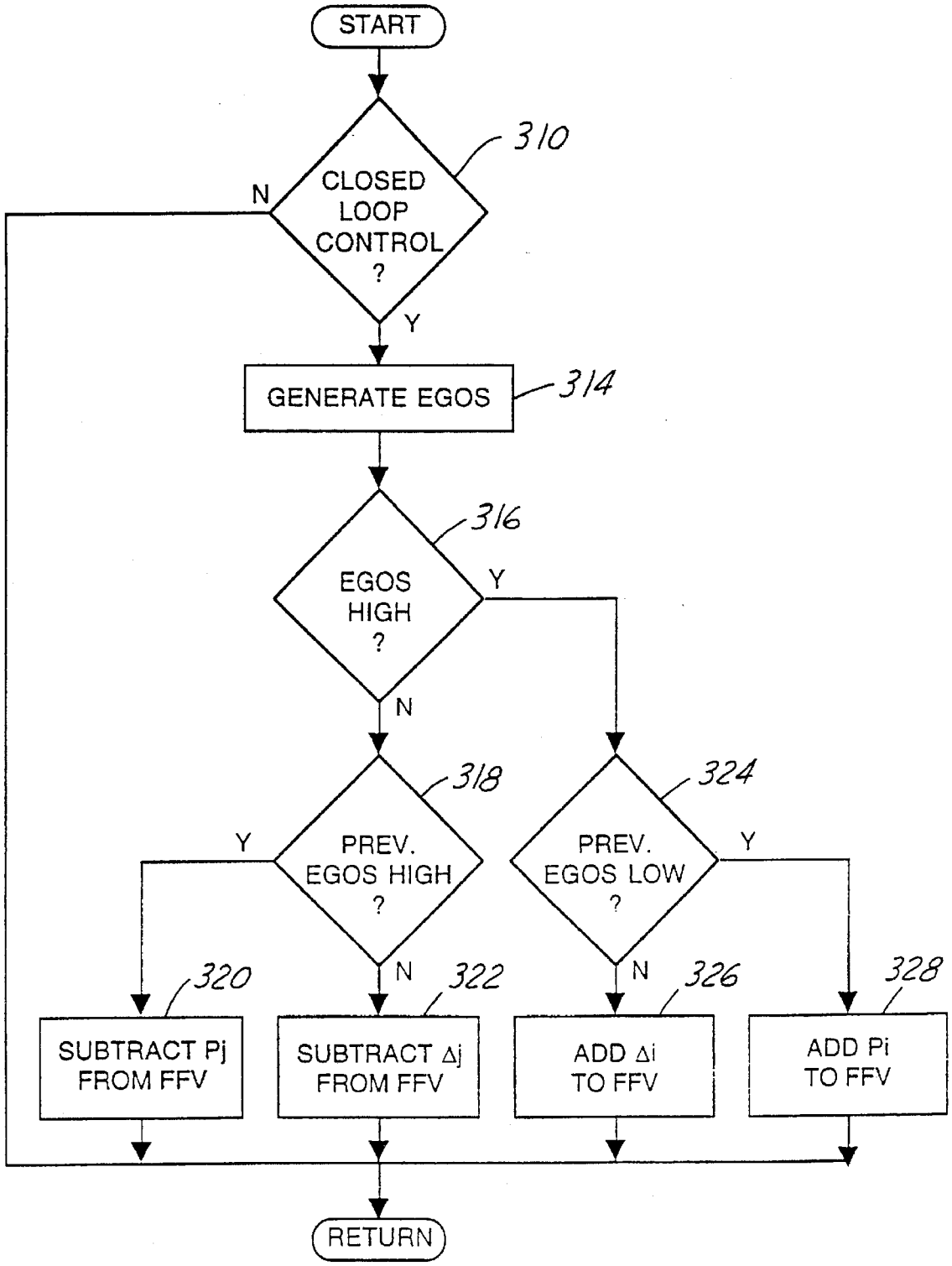

The air/fuel feedback routine executed by controller 12 to generate fuel feedback variable FV is now described with reference to the flowchart shown in FIG. 3. Two-state signal EGOS is generated from signal EGO (314) in the manner previously described herein with reference to FIG. 1. Preselected proportional term Pj is subtracted from feedback variable FV (step 320) when signal EGOS is low (step 316), but was high during the previous background loop of controller 12 (step 318). When signal EGOS is low (step 316), and was also low during the previous background loop (step 318), preselected integral term Δj is subtracted from feedback variable FV (step 322).

Similarly, when signal EGOS is high (step 316), and was also high during the previous background loop of controller 12 (step 324), integral term Δi, is added to feedback variable FV (step 326). When signal EGOS is high (step 316), but was low during the previous background loop (step 324), proportional term Pi is added to feedback variable FV (step 328).

In accordance with the above described operation, feedback variable FV is generated from a proportional plus integral controller (Pi) responsive to exhaust gas oxygen sensor 76. The integration steps for integrating signal EGOS in a direction to cause a lean air/fuel correction are provided by integration steps Di, and the proportional term for such correction provided by Pj. Similarly integral term Dj and proportional term Pj cause rich air/fuel correction.

Figure 4:
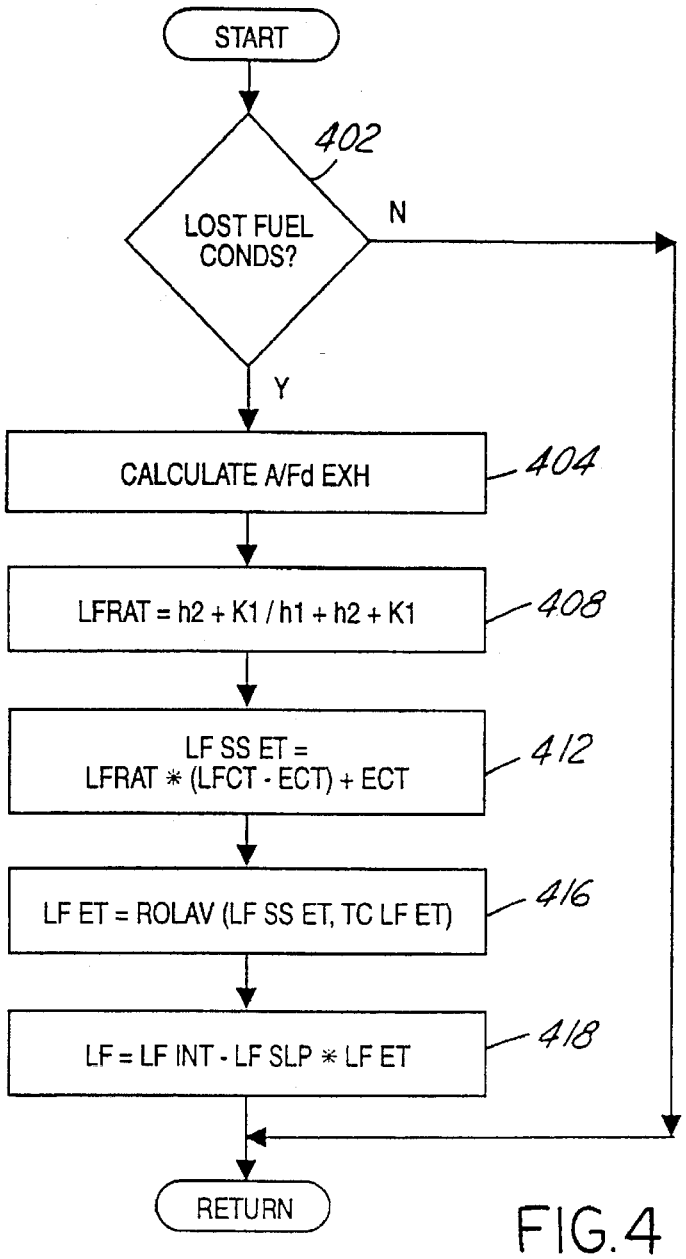

The subroutine for calculating the quantity of fuel lost between piston 36 and the inner wall of cylinder 32 (signal LF) is now described with particular reference to FIG. 4. The subroutine is initiated when those conditions under which lost fuel is likely to occur (such as after a cold engine start) are identified (402). Desired exhaust air/fuel ratio (A/Fd EXH) is then determined during step 404. Typically, signal A/Fd EXH is the stoichiometric air/fuel ratio.

Heat transfer ratio LFRAT between combustion chamber 30 and coolant jacket 114 is calculated during step 408. More specifically, the sum of heat transfer ratios between combustion chamber 30 and the inside wall of cylinder 32 (h1), and the heat transfer ratio across cylinder 32 to coolant sleeve 114 (k1), and the heat transfer ratio from coolant sleeve 114 to the coolant contained therein (h2), is divided into the sum of h2 plus k1.

The effective temperature of the inside wall of cylinder 32 (LFET) is generated during steps 412 and 416. First, steady-state effective temperature (LFSSET) is generated by multiplying lost fuel heat transfer ratio LFRAT times the difference between the estimated temperature of combustion chamber 30 and engine coolant temperature ET. The product is then added to engine coolant temperature ET to generate steady-state effective temperature LFSSET. In this particular example, an estimate of combustion temperature LFCT is provided from a look-up table addressed by engine load. In another embodiment, the look-up table is addressed by engine speed and load. Effective temperature LFET is then generated during step 416 by taking the rolling average of the steady-state effective temperature (LFSSET) and filtering this value by time constant TCLFET.

Figure 5:
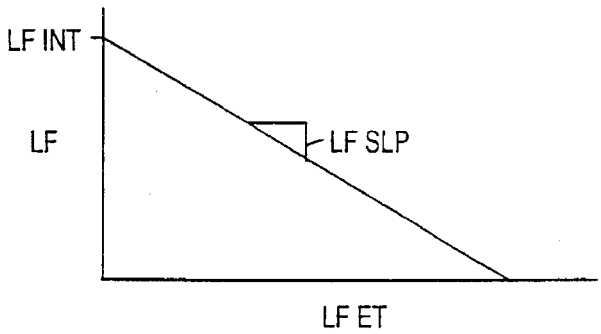
FIG. 5 is graphical representation of various signals generated by the embodiment shown in FIG. 1.

Lost fuel LF is shown graphed as a linear function of effective temperature LFET in FIG. 5. The slope is designated as LFSLP and the (y) intercept is shown as LFINT. Referring back to step 418 of FIG. 4, lost fuel signal LF is finally generated by subtracting the product of slope LFSLP times effective temperature LFET from intercept value LFINT.

Figure 6A:
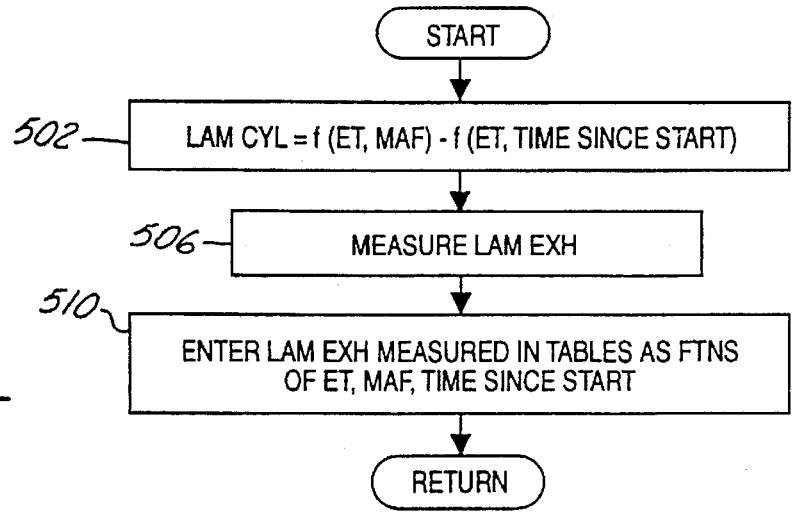
Figure 6B:
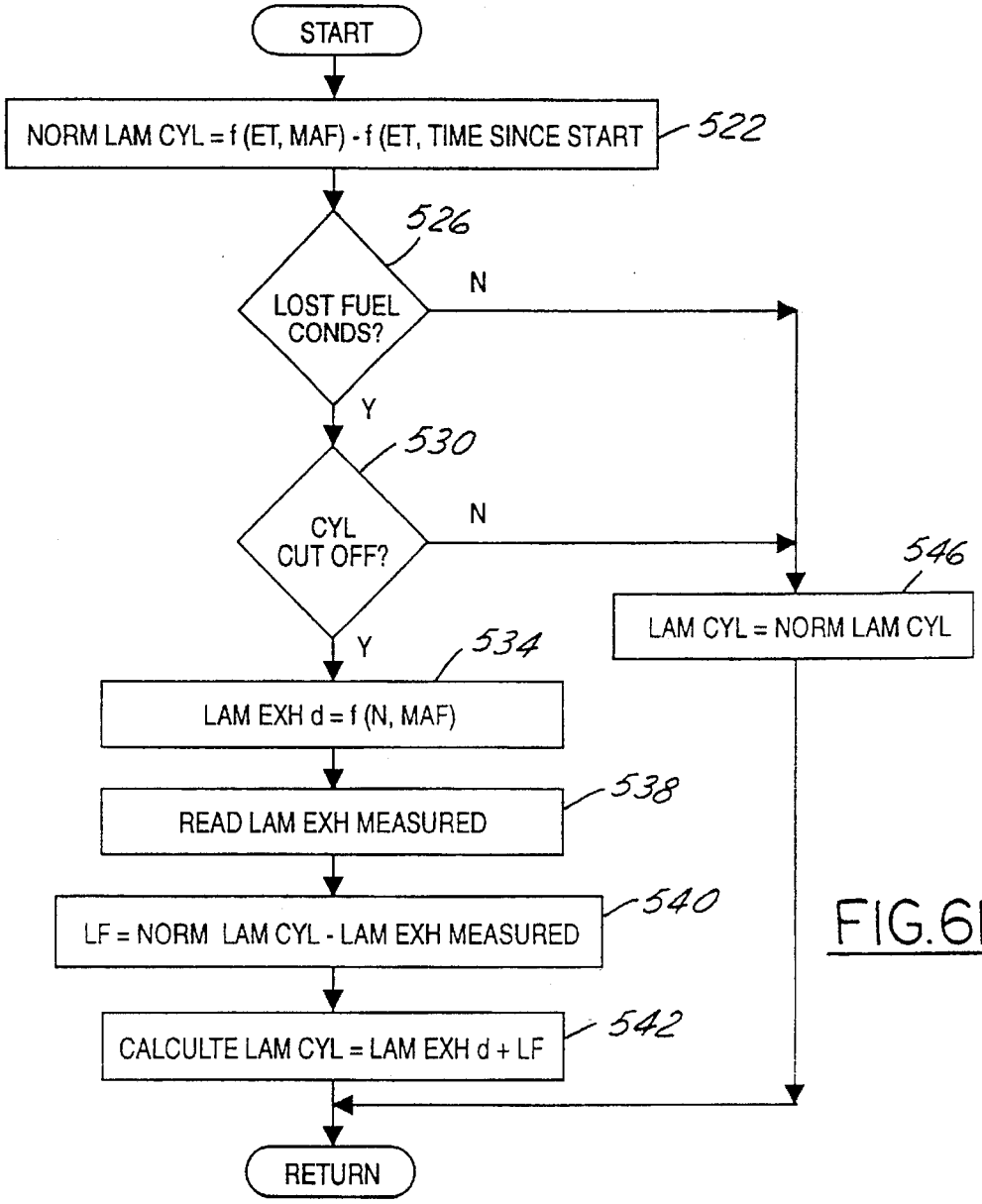

Another embodiment for generating lost fuel signal LF and adjusting the engine air/fuel ratio by signal LF is shown in FIGS. 6A and 6B. In this particular example, lost fuel signal LF is generated once for engine 10 by the calibration routine shown in FIG. 6A. At block 502, equivalence air/fuel ratio LAM CYL for the combustion chambers is provided from a difference between: a first table which is a function of engine coolant temperature ET and inducted mass airflow MAF; and a second table which is a function of engine coolant temperature ET and time since engine start. The engine exhaust air/fuel equivalence ratio is measured (LAM EXH MEASURED) by proportional exhaust gas oxygen sensor 78 for a variety of engine conditions (temperature, speed, and load) as shown at block 506. Exhaust air/fuel equivalence ratio LAM EXH MEASURED is entered in tables as functions of engine coolant temperature ET, inducted airflow MAF, and time since engine start (510).

Referring now to FIG. 6B, a description of providing an indication of lost fuel LF from measured equivalence ratio LAM EXH MEASURED is now provided. Normal equivalence air/fuel ratio NORM LAM CYL for the combustion chambers is provided from a difference between: a first table which is a function of engine coolant temperature ET and inducted mass airflow MAF; and a second table which is a function of engine coolant temperature ET and time since engine start (522).

During lost fuel conditions (526), and cylinder cut off conditions (530), the effective air/fuel equivalence ratio desired in the engine exhaust (LAMEXHd) is determined during step 534 as a function of engine speed N and inducted mass airflow MAF. Engine cylinders are disabled in a conventional manner during traction control to reduce engine torque when a vehicle wheel is detected as slipping.

Lost fuel LF is generated during step 540 by subtracting measured air/fuel equivalence ratio LAM EXH MEASURED (538) from normal air/fuel equivalence ratio NORM LAM CYL. A new air/fuel equivalence ratio LAM CYL for use in generating pulse width signal fwp is generated during step 542 by adding lost fuel LF to desired air/fuel equivalence ratio LAMEXHd.

When lost fuel conditions are not present (526) and cylinder cutoff conditions are not present (530), air/fuel equivalence ration LAM CYL is set equal to normal air/fuel equivalence ration NORM LAM CYL (546).

This concludes the description of an example of operation of an embodiment which uses the claimed invention to advantage. Although two examples were described herein, those skilled in the art will be aware of numerous examples which practice the claimed invention. Accordingly, it is intended that the invention be limited only by the following claims:

What is claimed:

1. A method for controlling an internal combustion engine having a plurality of combustion chambers coupled to an engine exhaust and thermally communicating with a coolant jacket, each of the combustion chambers including a cylinder having an inner wall with a piston positioned therein, comprising the steps of:

delivering fuel to the engine;

calculating a quantity of said delivered fuel which is lost between the piston and the cylinder inner wall during a predetermined engine operating condition; and adjusting said delivered fuel for said calculated lost quantity to achieve a desired engine air/fuel ratio.

2. The method recited in claim 1 wherein said step of calculating said lost fuel quantity is at least dependent upon temperature of said coolant jacket.

3. The method recited in claim 2 further comprising a step of calculating a heat transfer ratio between the combustion chambers and the coolant jacket and wherein said step of calculating said lost fuel quantity is at least dependent upon said heat transfer ratio.

4. The method recited in claim 1 wherein said step of detecting said predetermined engine operating condition is related to said coolant jacket temperature.

5. The method recited in claim 4 wherein said predetermined engine operating condition is further related to a time constant.

6. The method recited in claim 1 further comprising a step of disabling a plurality of the combustion chambers in response to a preselected condition.

7. The method recited in claim 1 further comprising the steps of retrieving a previously measured exhaust air/fuel ratio and providing an estimated air/fuel ratio in the combustion chamber corresponding to said measured exhaust air/fuel ratio, and wherein said lost fuel calculating quantity step includes taking a difference between said measured exhaust air/fuel ratio and said estimated combustion chamber air/fuel ratio.

8. The method recited in claim 7 further comprising a calibration step of measuring exhaust air/fuel ratio once for the engine to provide said previously measured exhaust air/fuel ratio.

9. A method for controlling an internal combustion engine having a plurality of combustion chambers coupled to an engine exhaust and thermally communicating with a coolant jacket, each of the combustion chambers including a cylinder having an inner wall with a piston positioned therein, comprising the steps of:

delivering fuel to the engine;

inferring temperature of the cylinder inner wall;

calculating a quantity of said delivered fuel which is lost between the piston and the cylinder inner wall from said inferred inside wall temperature during a predetermined engine operating condition; and adjusting said delivered fuel for said calculated lost quantity to achieve a desired engine air/fuel ratio.

10. The method recited in claim 9 further comprising a step of calculating a heat transfer ratio from the combustion chambers and wherein said step of inferring cylinder inside wall temperature is dependent upon said calculated heat transfer ratio and a measurement of engine temperature.

11. The method recited in claim 10 wherein said measurement of engine temperature comprises a measurement of the coolant in the coolant jacket and wherein said heat transfer ratio corresponds to heat transfer between the combustion chambers and the coolant jacket.

12. The method recited in claim 11 wherein said step of calculating said heat transfer ratio includes a ratio of a sum of a first heat transfer coefficient between the coolant jacket and the coolant and a second heat transfer ratio between said inside cylinder wall and the coolant jacket to a sum of said first heat transfer coefficient and said second heat transfer coefficient and a heat transfer coefficient between the combustion chamber and said inside cylinder wall.

13. A method for controlling an internal combustion engine having a plurality of combustion chambers coupled to an engine exhaust and thermally communicating with a coolant jacket, each of the combustion chambers including a cylinder with a piston positioned therein, comprising the steps of:

delivering fuel to the engine;

calculating a heat transfer ratio between the combustion chambers and the coolant jacket;

inferring temperature of the combustion chambers from at least one engine operating parameter;

inferring inside wall temperature of the cylinders from at least said heat transfer ratio and said coolant jacket temperature and said inferred combustion chamber temperature;

calculating a quantity of said delivered fuel which is lost between the piston and the cylinder during a predetermined engine operating condition from said inferred inside wall temperature; and adjusting said delivered fuel for said calculated lost quantity to achieve a desired engine air/fuel ratio.

14. The method recited in claim 12 wherein said step of inferring cylinder inside wall temperature is further dependent upon a time constant.

* * * * *